US009754494B2

(12) United States Patent
Irfan et al.

(10) Patent No.: US 9,754,494 B2
(45) Date of Patent: Sep. 5, 2017

(54) AIR TRAFFIC CONTROL

(75) Inventors: Melodi Irfan, Hampshire (GB); Michael John Bull, Hampshire (GB); Andrew Trevor Clinch, Hampshire (GB); Stephen James Pember, Hampshire (GB)

(73) Assignee: NATS (EN ROUTE) PUBLIC LIMITED COMPANY, London (GB)

( * ) Notice: Subject to any disclaimer, the term of this patent is extended or adjusted under 35 U.S.C. 154(b) by 491 days.

(21) Appl. No.: 13/497,224

(22) PCT Filed: Sep. 21, 2010

(86) PCT No.: PCT/GB2010/001767

§ 371 (c)(1),
(2), (4) Date: Aug. 7, 2012

(87) PCT Pub. No.: WO2011/033273

PCT Pub. Date: Mar. 24, 2011

(65) Prior Publication Data

US 2012/0303253 A1 Nov. 29, 2012

(30) Foreign Application Priority Data

Sep. 21, 2009 (GB) ..... 0916590.3
Jun. 18, 2010 (GB) ..... 1010298.6

(51) Int. Cl.
*G08G 5/00* (2006.01)

(52) U.S. Cl.
CPC ..... *G08G 5/0026* (2013.01); *G08G 5/0043* (2013.01); *G08G 5/0082* (2013.01)

(58) Field of Classification Search
CPC ..... G08G 5/04; G08G 5/0026; G08G 5/0043; G08G 5/0082
See application file for complete search history.

(56) References Cited

FOREIGN PATENT DOCUMENTS

| | | | |
|---|---|---|---|
| FR | 2854978 | A1 | 11/2004 |
| WO | 2007072015 | A2 | 6/2007 |
| WO | 2007072028 | A2 | 6/2007 |
| WO | 2008001117 | A1 | 1/2008 |
| WO | 2008001122 | A1 | 1/2008 |

OTHER PUBLICATIONS

Written Opinion of the International Searching Authority and International Search Report for PCT/GB2010/001767, completed on Jan. 7, 2011 and mailed Feb. 14, 2011, 11 pages.

(Continued)

*Primary Examiner* — Mussa A Shaawat
*Assistant Examiner* — Michael Kerrigan
(74) *Attorney, Agent, or Firm* — Procopio, Cory, Hargreaves & Savitch LLP

(57) ABSTRACT

An air traffic control system in which several tactical sectors each control of a respective tactical controller can be amalgamated into a single super-sector under control of a single planning controller. The tactical controllers can collaboratively manage flights in neighboring tactical sectors within the same planning sector and have awareness of selected flights and interactions outside their own tactical sector; the invention assesses and selects which flights to display for each controller (based upon separation responsibility).

21 Claims, 11 Drawing Sheets

(56) References Cited

OTHER PUBLICATIONS

Herr et al. "The impact of multi sector planning and new working procedures on controller tasks." The 24th Digital Avionics Systems Conference (IEEE Cat. No. 05CH37708). vol. 1, Oct. 30-Nov. 3, 2005, pp. 3.B.5-1-3.B.5-11.

Prevot et al. "Tools for Trajectory-Based Air Traffic Control and Multi Sector Planning." Retrieved from the Internet: http://humansystems.arc.nasa.gov/publications/Prevot-06-HCI-Aero-Trajectory-MSP-Tools.pdf. HCI-Aero 2006, Seattle, WA, Sep. 2006, 8 pages.

Leiden et al. "Trajectory Orientation: A Technology-Enabled Concept Requiring a Shift in Controller Roles and Responsibilities." 3rd USA/Europe Air Traffic Management R&D Seminar, Napoli. Jun. 13-16, 2000. Retrieved from the internet: http://atmseminar.org/seminarcontent/seminar3/papers/p_081_DSTCDM.pdf, 11 pages.

Corker et al. "New Air Traffic Management Concepts Analysis Methodology: Application to a Multi-Sector Planner in US Airspace." Retrieved from the internet: http://atm-seminar-2000.eurocontrol.fr/past-seminars/7th-seminar-barcelona-spain-july-2007/papers/paper_170. 2007, 11 pages.

Meckiff et al. "The Tactical Load Smoother for Multi-Sector Planning." 2nd USA/Europe Air Traffic Management R&D Seminar, Orlando. Dec. 1-4, 1998. Retrieved from the internet: http://www.atmseminar.org/seminarContent/seminar2/papers/p_040_FOC.pdf, 12 pages.

AIR TRAFFIC CONTROL

This invention relates to computerised systems for aiding air traffic control.

Air traffic control involves human staff communicating with the pilots of a plurality of planes, instructing them on profiles (consisting of altitudes and azimuthal routes) so as to avoid collisions. Aircraft generally file "flight plans" indicating their routes before flying, and from these, the controllers have some initial information on the likely positions and trajectories of aircraft, but flight plans are inherently subject to variation (due, for example, to delays in take offs; changes of speed due to head wind or tails wind; and permitted modifications of the course or altitude by the pilot). In busy sectors (typically, those close to airports), significant tactical control of the aircraft by the controllers is necessary.

The controllers are supplied with data on the position and altitude of the aircraft from radar units and ask the pilots for information such as altitude, heading and speed. They instruct the pilots by radio to maintain their headings and speeds, alter their headings and speeds in a predetermined fashion, or maintain or alter their altitudes (for example to climb to a certain altitude or to descend to a certain altitude) so as to maintain safe minimum separation between aircraft and, thus, to avoid the risk of collisions.

Standards are set for separating aircraft horizontally and vertically so as to make the likelihood of collision very low even if such separation standards are breached due to errors or local conditions (e.g. weather conditions, ground or airborne system failures). Collisions are therefore extremely rare, even in the busiest areas, due to the continual monitoring and control of aircraft by the air traffic controllers, for whom safety is, necessarily, the most important criterion.

On the other hand, with continual growth of air transportation, due to increasingly globalised trade, it is important to maximise the throughput of aircraft and the handling capacity of controllers to the extent that this is compatible with safety. Further increasing throughput with existing air traffic control systems is increasingly difficult. It is difficult for air traffic controllers to monitor the positions and headings of too many aircraft at one time on conventional equipment, and human controllers necessarily err on the side of caution in separating aircraft.

Some prior air traffic control systems are discussed in our earlier applications WO 2008/001117, WO 2008/001122, WO2007/072028, and WO 2007/072015, and the documents there referred to.

As disclosed in those documents, it is common to divide airspace into "sectors" having defined geographical horizontal and vertical boundaries. Sectors are contiguous, either beside each other or, in some cases, above or below one another. Each sector is generally the responsibility of two sector controllers, who handle aircraft within the sector. These are a planning controller, who decides whether and how to accept an incoming aircraft into the sector and sets its sector exit condition, working on the basis of the aircraft flight plans and those of other aircraft in the sector, and a tactical (or radar) controller, who actively controls and routes aircraft within the sector using primarily radar data so as to maintain good separation and achieve the desired sector exit conditions. The controllers see full information only on aircraft within their own sector and those due to arrive imminently. Tactical controllers enter into radio contact with incoming aircraft, but in general, tactical responsibility (or "control") is passed from one controller to the next as the aircraft passes the "transfer of control point" (very often the sector boundary).

This is not universally the case, because operational procedures may sometimes be applied that modify this arrangement, for example standing agreements where transfer of control is coincident with transfer of communications (regardless of the position of the aircraft relative to the sector boundary), so that the receiving sector may alter the clearance without waiting for the aircraft to enter his sector's airspace. There are usually some restrictions on the clearances that can be issued whilst it is still in the previous sector's airspace, such as turning the aircraft only as far as might be considered consistent with it maintaining its anticipated direction of flight etc.

This arrangement has worked well for many years, and is typical of many organisations internationally. However, there is interest in enabling a more flexible deployment of air traffic controllers, who are a scarce resource. Some sectors are busy at some times and not at others, and it would be desirable to be able to reduce the number of controllers required below 2*N (where N is the fixed number of sectors). One operational method for doing so is so-called "bandboxing". In bandboxing, at times when several adjacent sectors are not too busy; they are combined into one large sector group, releasing several pairs of planning and tactical controllers. When the sector becomes busy again, it is split back into the original smaller sectors and pairs of planning and tactical controllers are allocated to each. Whilst bandboxed, the sector is still controlled by a tactical controller-planning controller pair.

An aim of the present invention is therefore to provide computerised support systems for air traffic control which allow human controllers to increase the throughput of aircraft. More specifically, an aim is to provide computerised support systems for air traffic control which allow controllers to work more flexibly, without overloading them with information. The invention in various aspects is defined in the claims appended hereto, with advantages and preferred features which will be apparent from the following description and drawings.

Embodiments of the invention will now be illustrated, by way of example only, with reference to the accompanying drawings in which.

GENERAL DESCRIPTION OF AIR TRAFFIC CONTROL SYSTEM

Figure 1:
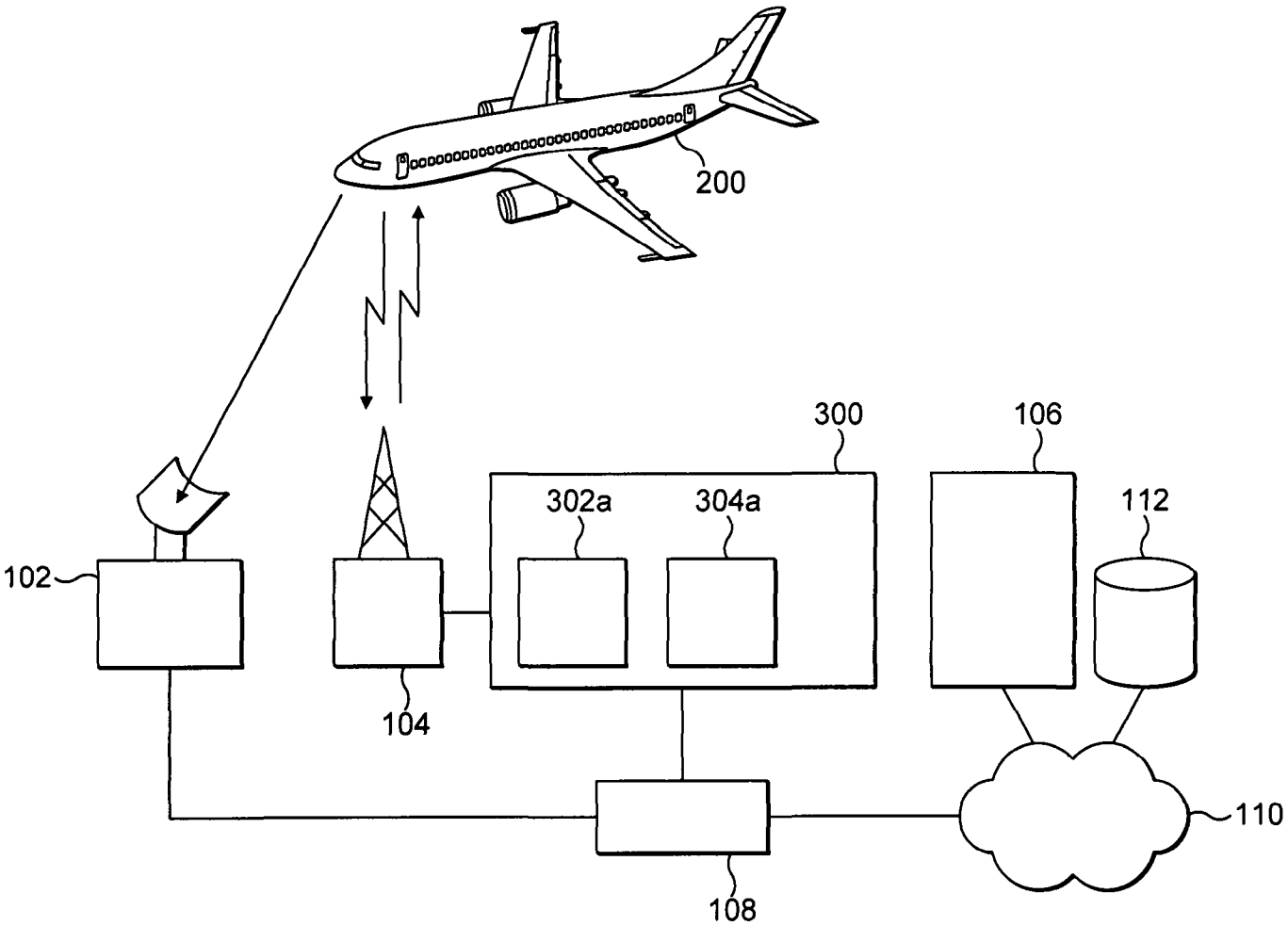
FIG. 1 is a block diagram showing an air traffic control system for a sector of airspace in accordance with an embodiment of the invention.

FIG. 1 shows the hardware elements of an air traffic control system (known per se, and used in the present embodiments). In FIG. 1, a radar tracking system, denoted 102, comprises a radar unit for tracking incoming aircraft, detecting bearing and range ("primary radar") and altitude (transponded by "secondary radar"), and generating output signals indicating the position of. each aircraft, at periodic. intervals. A radio communications station 104 is provided for voice communications with the cockpit radio of each aircraft 200. A meteorological station 106 is provided for collecting meteorological data and outputting measurements and forecasts of wind, speed and direction, and other meteorological information. A server computer 108 communicating with a communication network 110 collects data from the radar system 102 and (via the network 110) the meteorological station 106, and provides the collected data to an air traffic control centre 300. Data from the air traffic control centre 300 is, likewise, returned to the server computer for distribution through the network 110 to air traffic control systems in other areas.

A database 112 stores information on each of a plurality of aircraft 200, including the aircraft type, and various performance data such as the minimum and maximum weight, speed, and, maximum rate of climb.

The airspace for which the air traffic control centre 300 is responsible is divided into a plurality of sectors each with defined geographical and vertical limits and controlled by planning and tactical controllers.

The air traffic control centre 300 comprises a plurality of workstations 302*a*, 302*b*, . . . for planning controllers, and a plurality of workstations 304*a*, 304*b*, . . . for tactical controllers. The role of the planning controllers is to decide whether and how to accept an aircraft flight in their respective sector within the volume of air space controlled by the air traffic control centre 300 and, if accepted, to set its exit conditions, as discussed in greater detail below. The planning controller receives flight plan data regarding the aircraft, and information from a neighbouring sector, and, if the flight is accepted, accepts an entry "flight level" (NFL) or altitude for the aircraft entering the sector, and provides an exit flight level (XFL) or altitude for an aircraft exiting the sector, and a broadly defined route between an entry point and an exit point of the sector. If the planning controller finds that the sector is likely to be too crowded to accept the flight as offered, he either amends the entry criteria or, if no alternative is suitable, declines the flight.

The planning controller therefore considers primarily the intended flight plan of the aircraft, and the general level of busyness of the sector and anticipated positions of other aircraft, and sets only an outline trajectory through the sector for each aircraft, generally as a simple target sector exit flight level (XFL).

Figure 2:
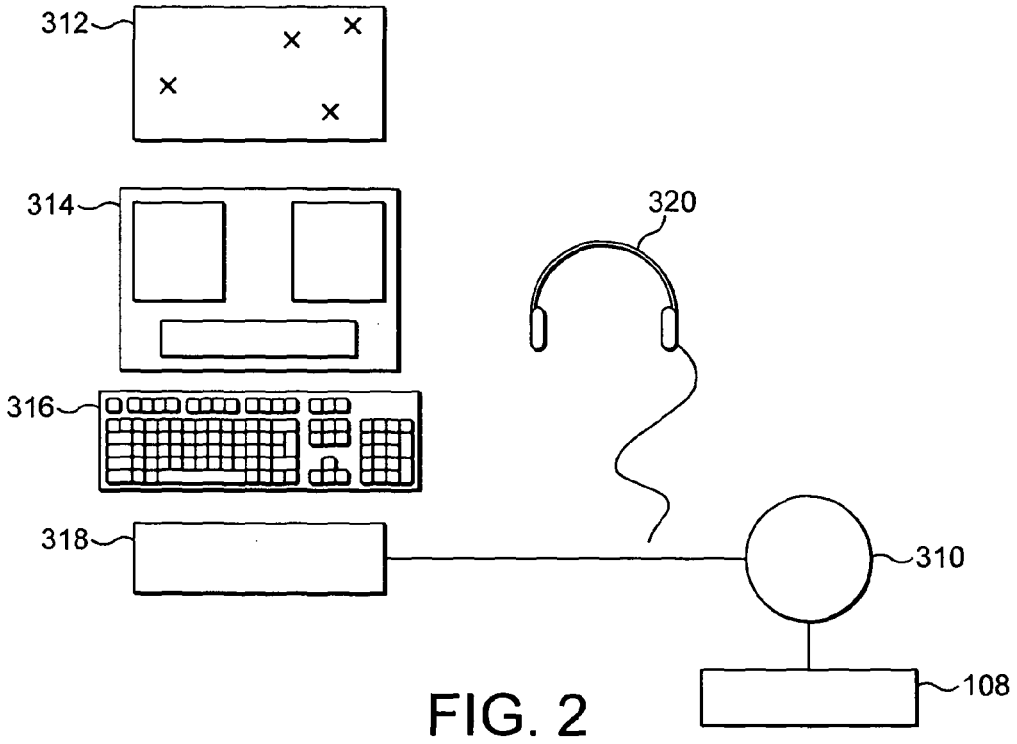
FIG. 2 is a block diagram showing the elements of a tactical air traffic controller's workstation forming part of FIG. 1.

Referring to FIG. 2, each workstation 304 for a tactical controller comprises a radar display screen 312 which shows a conventional radar view of his allocated sector, with the sector boundaries, the outline of geographical features such as coastline, the position and surrounding airspace of any airfields (all as a static display), and a dynamic display of the position of each aircraft received from the radar system 102, together with an alphanumeric indicator of the flight number of the aircraft. The tactical controller can therefore see, at any moment, the three dimensional position (level, and latitude and longitude or X/Y co-ordinates) of the aircraft in the sector. A headset 320 comprising an earpiece and microphone is connected with the radio station 104 to allow the controller to communicate with each aircraft 200.

A visual display unit 314 is also provided, on which a computer workstation 318 can cause the display of one or more of a plurality of different display formats, under control of the controller operating the keyboard 316 (which is a modified QWERTY keyboard). A local area network 308 interconnects all the workstation computers 318 with the server computer 108. The server computer 108 distributes data to the terminal workstation computers 318, and accepts from them data entered via the keyboard 316.

Software Present on Server 108

Figure 3:
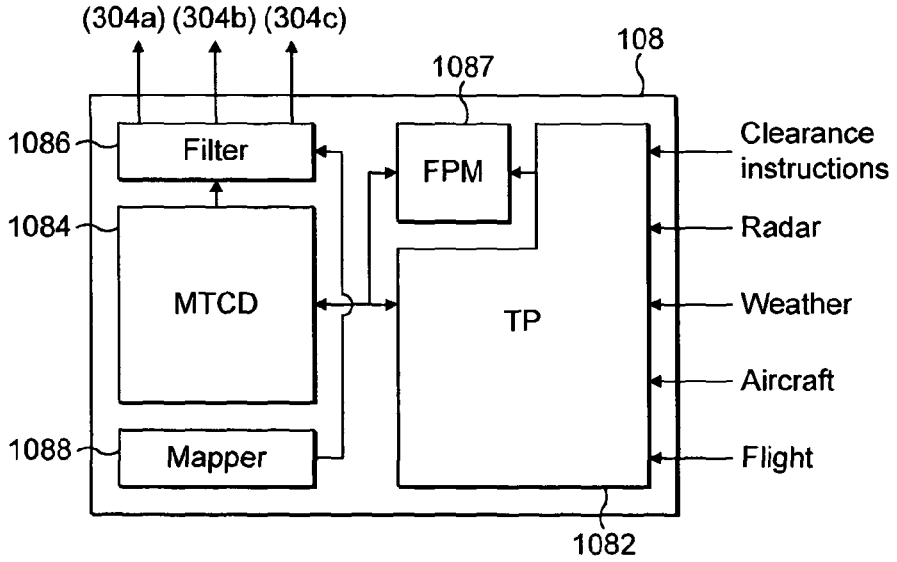
FIG. 3 is a diagram showing the software present in a host or server computer making up part of FIG. 1.

Referring to FIG. 3, the principal software executing on the server 108 is indicated. It consists of a trajectory prediction (TP) program 1082 and a medium term conflict detection (MTCD) program 1084, a filtering program 1086, a Flight Path Monitoring (FPM) program 1087, and a sector mapping program 1088.

Arrangement of Sectors of Embodiments of the Invention

Figure 4:
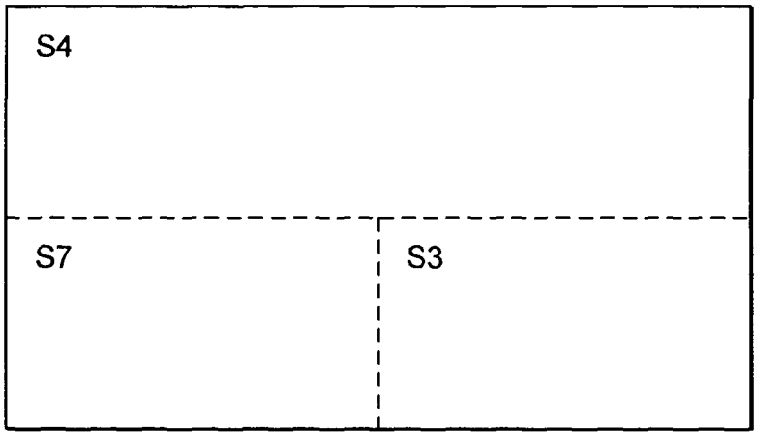
FIG. 4 is a schematic diagram (not to shape or scale) illustrating an arrangement of tactical sectors mapped to a planning sector according to the preferred embodiment.

FIG. 4 shows an arrangement of sectors according to the present invention. Neighbouring sectors; these may adjoin each other horizontally, or vertically, or both so as to define an overhang. In FIG. 4, three contiguous prior art sectors S3, S4, S7 are grouped together into a "super-sector" or planning sector S occupying the same volume of space, operated by a single planning controller from a single workstation 302.

Figure 5:
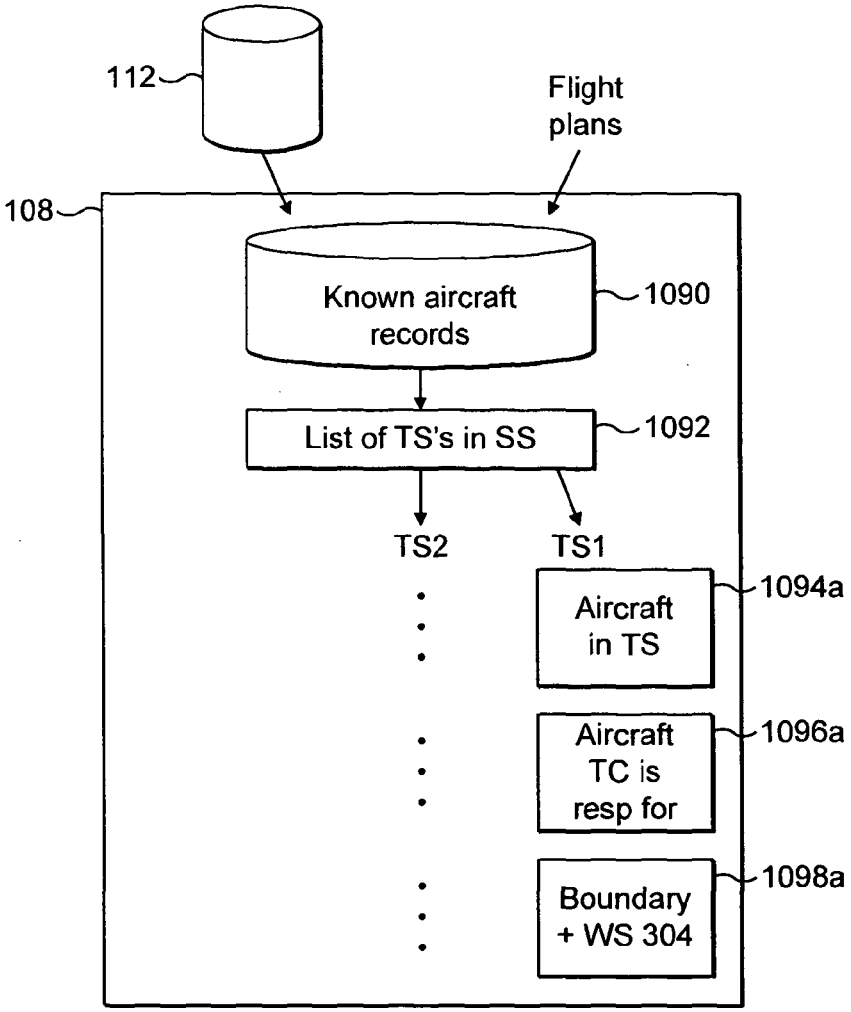
FIG. 5 is a diagram showing the data structures present in and used by a host or server computer making up part of FIG. 1.

Referring to FIG. 5, data structures used by present embodiments are shown. The computer 108 holds, for each super-sector S, a database 1090 of "known" aircraft—i.e. aircraft in, approaching, or recently exited from the super-sector Each aircraft record in the database is populated by data from the aircraft database and flight plan data from the originating sector with which the flight plan was filed, and with additional position, route and clearance data input or calculated as described hereunder, such as sector entry and exit flight levels (NFL, XFL).

The sector mapping program 1088 uses a mapping list structure which maps either one or a plurality of tactical sectors to the super-sector. For each of the tactical sectors, the computer 108 stores coordinates defining the boundaries of each "subsector" S3, S4, S7, together with an indication of a workstation 304*a*, 304*b*, 304*c* associated with each, in a sector definition record 1098. Also stored are: a list of the aircraft currently in the tactical sector 1094, and a list of the aircraft currently controlled by the respective tactical controller 1096 (the two lists overlap but as disclosed herein are not identical).

Figure 6:
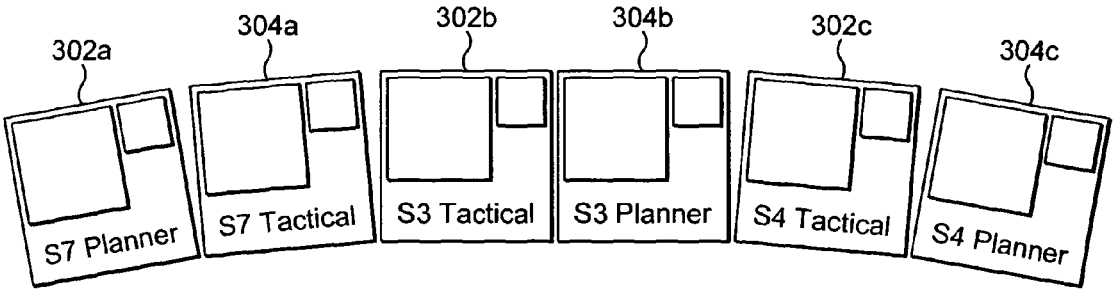
FIG. 6 is a diagram showing a physical arrangement of workstations forming part of FIG. 1 operating with separate sectors.

At times when there is heavy traffic, the planning controller can input a command to cause the sector mapping program 1088 to break the super-sector S into three separate planning sectors S3, S4, S7 each coterminous with a tactical sector, and allocate separate responsibility to three respective planning controllers at a workstations 302*a*, 302*b*, 302*c* as shown in FIG. 6, and as in the prior art. Separate databases 1090 and records 1092 are created for each. The embodiment then operates in the same manner as described in our earlier applications WO2007/072028 and WO2007/072015 (incorporated herein by reference).

Figure 7:
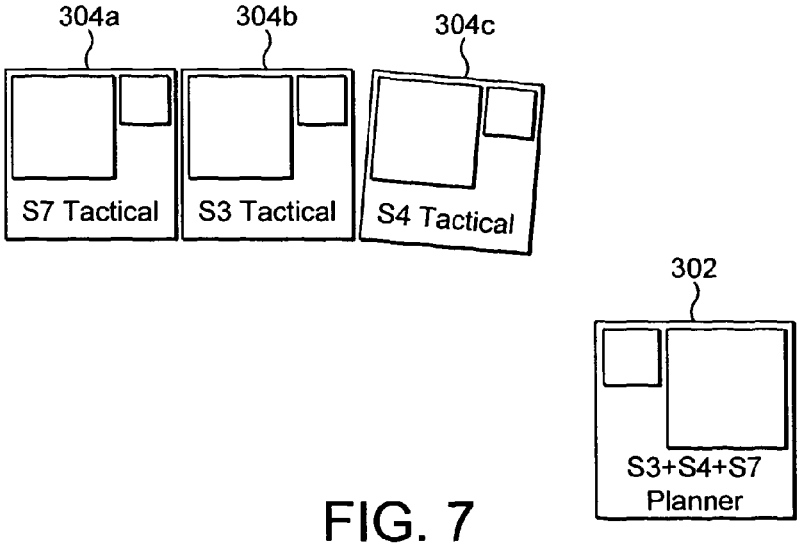
FIG. 7 is a diagram corresponding to FIG. 6 and showing a physical arrangement of workstations forming part of FIG. 1 operating with several tactical sectors mapped to a single planning sector according to FIG. 4.

On the other hand, at times when traffic levels and patterns so permit, the planning controller can input a command to cause the sector mapping program 1088 to map the super-sector onto the three subsectors S3, S4, S7, which are hereafter referred to as "tactical sectors", each operated by a respective tactical controller at a respective workstation 304*a*, 304*b*, 304*c* and a single planning controller at a workstation 302, as shown in FIG. 7. Two planning controllers are thereby released for other duties.

General Description of the Operation of Embodiments of the Invention

In general, in the present invention, the rigid link between tactical controllers and their sector boundaries is made flexible. Each tactical controller is "more responsible" for flights in his tactical sector than for those outside, but (by way of contrast with the prior art) each can also see interactions (i.e. predicted future close approaches between aircraft) with flights which are predicted to take place outside his tactical sector but elsewhere within the super-sector of which it forms part, and against aircraft for which he does not have control responsibility.

Although normally a tactical controller is responsible for each aircraft within his tactical sector, as in the prior art, in the preferred embodiment each tactical controller can also take responsibility for aircraft outside his tactical sector(but within the super-sector), and may do so for example where he has been controlling an aircraft in his tactical sector and can see, on the basis of available information, a profile which offers the necessary separation through the airspace of other tactical sector(s) to the boundary of the super-sector. He may then clear the aircraft to its super-sector exit flight level (XFL) or another level that is outside his own tactical sector.

Equally, it may be convenient for a tactical controller to take control of an aircraft outside his tactical sector to resolve a conflict or interaction (i.e. predicted close approach) with another aircraft within his sector. Tactical controllers allocated to tactical sectors S3, S4, S7 mapped to the same super-sector S are provided in preferred embodiments with a messaging facility so that one can request another (usually a neighbour) to take responsibility for resolving an interaction. As a tactical controller has less information on neighbouring tactical sectors than on his own, he will only take or keep control of aircraft outside his tactical sector where it appears to be unproblematic to do so.

To achieve this, tactical controllers must have information on flights throughout the super-sector and not just those within their own tactical sector. However, if each tactical controller saw all flights in the super-sector he would face a large volume of information which would, when busy, limit his capacity to control and react—he would effectively be tactical controller of the entire super-sector, as would his neighbouring tactical controllers within that super-sector.

The invention is aimed, in some aspects, at controlling the volume of information on aircraft within the super-sector but outside the tactical sector, and accordingly the medium term conflict detector program 1084 is arranged to assess all conflicting or interacting flights within the super-sector, and the filtering program 1086 is arranged to filter the interactions in accordance with predetermined criteria, and route them to the appropriate tactical controller workstation 304 for display in accordance with the sector mapping data held by the sector mapping program 1088.

Trajectory Predictor 1082

The general operation of the trajectory prediction program 1082 is discussed fully in our earlier applications WO2007/072028 and WO2007/072015 (incorporated herein by reference) and a summary will now be given. The trajectory prediction program 1082 is arranged to receive data and calculate, for each aircraft in or approaching or exiting the planning sector, a trajectory through the sector. The trajectory is calculated taking into account the current aircraft position and level (derived from the radar system 102 and updated every 6 seconds), the flight plan, and a range of other data including weather data and aircraft performance data (as discussed in greater detail in our earlier applications WO2007/072028 and WO2007/072015).

Figure 8:
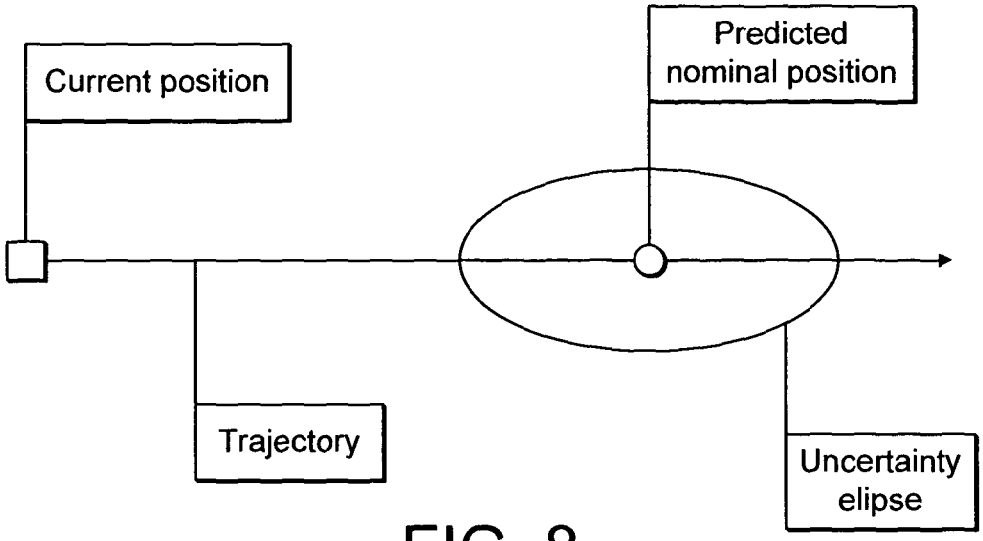
FIG. 8 is a diagram showing the position, trajectory and uncertainty therein of an aircraft according to the present embodiment.

The trajectory calculated for each aircraft covers preferably at least the next 20 minutes. The output of the trajectory prediction program 1082 is data defining a number of points through which the flight is predicted to pass, defined in three dimensions, with time and velocity information at each point. Associated with each point is an uncertainty region, as shown in FIG. 8.

Thus, at every time of execution of the trajectory predictor 1082 (i.e. every 6 seconds), the server computer calculates, for each aircraft, a set of future trajectory points, starting with the known present position of the aircraft and predicting forward in time based on predicted rate of change of position and other variables to the next point; and so on iteratively for a 20 minute future window in time.

In the preferred embodiments, the trajectory projector is arranged to calculate two trajectories: an "actual" or "tactical" trajectory based on the current course and clearance of the aircraft, and an "implied" or "planning" trajectory, representing the aircraft's expected flight profile taking into account the flight plan, the super-sector exit boundary coordinates and co-ordination flight level and any current cleared flight levels or other instructions from the sector controllers. The implied trajectory is calculated on the basis that the aircraft will move to the next available waypoint on the flight plan to which it is cleared, climbing or descending immediately to any allocated Cleared Flight Level (CFL) and climbing or descending subsequently to the exit flight level (XFL).

The output of the trajectory predictor 1082 is supplied to the medium term conflict detector 1084. It is also available for display on a human machine interface (HMI) as discussed in greater detail below; for recording and analysis if desired; and for flight path monitoring by the program 1087.

Medium Term Conflict Detector 1084

The general operation of the medium term conflict detector 1084 is discussed fully in our earlier applications WO2007/072028 and WO2007/072015 (incorporated herein by reference) and a summary will now be given. In general, the conflict detector 1084 is intended to detect the spatial interactions (i.e. approaches) between pairs of aircraft. A given air traffic controller may need to be aware of 20 aircraft within his respective sector. Each aircraft may approach each other aircraft, leading to a high number of potential interactions.

Figure 9:
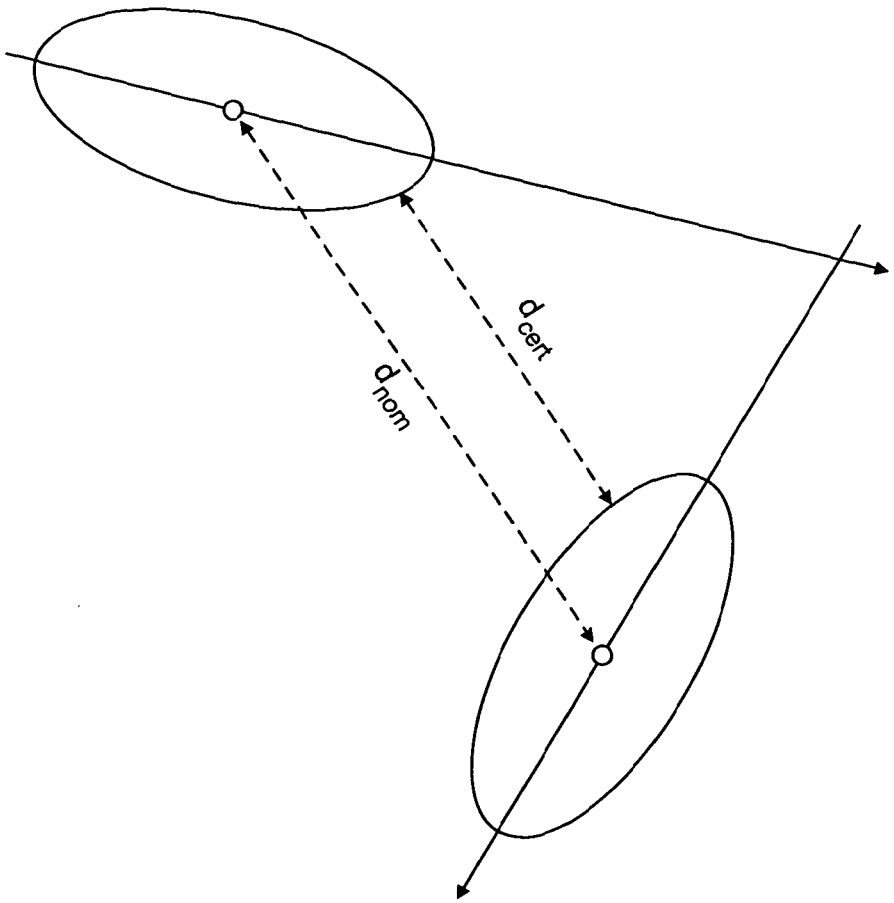
FIG. 9 is a diagram showing the geometry of an interaction between two aircraft in plan view.

Referring to FIG. 9, a snapshot of the predicted positions for two flights at a specified time in the future is shown. At this time, the distance between the nominal predicted positions, $d_{nom}$, is inevitably greater than the minimum distance between the uncertainty envelopes of the two aircraft. In FIG. 9, which is not to scale, the envelopes shown represent a 95% confidence level that the aircraft's future position at the time concerned will lie within the shaded ellipse. The elliptical shape is due to the multivariate statistical combination of the along track and across track errors, and would in general be different for the two aircraft (rather than similar as shown in the diagram). Given the calculated uncertainty, it is therefore important that the distance between the two regions of uncertainty $d_{cert}$, is calculated.

Figure 10:
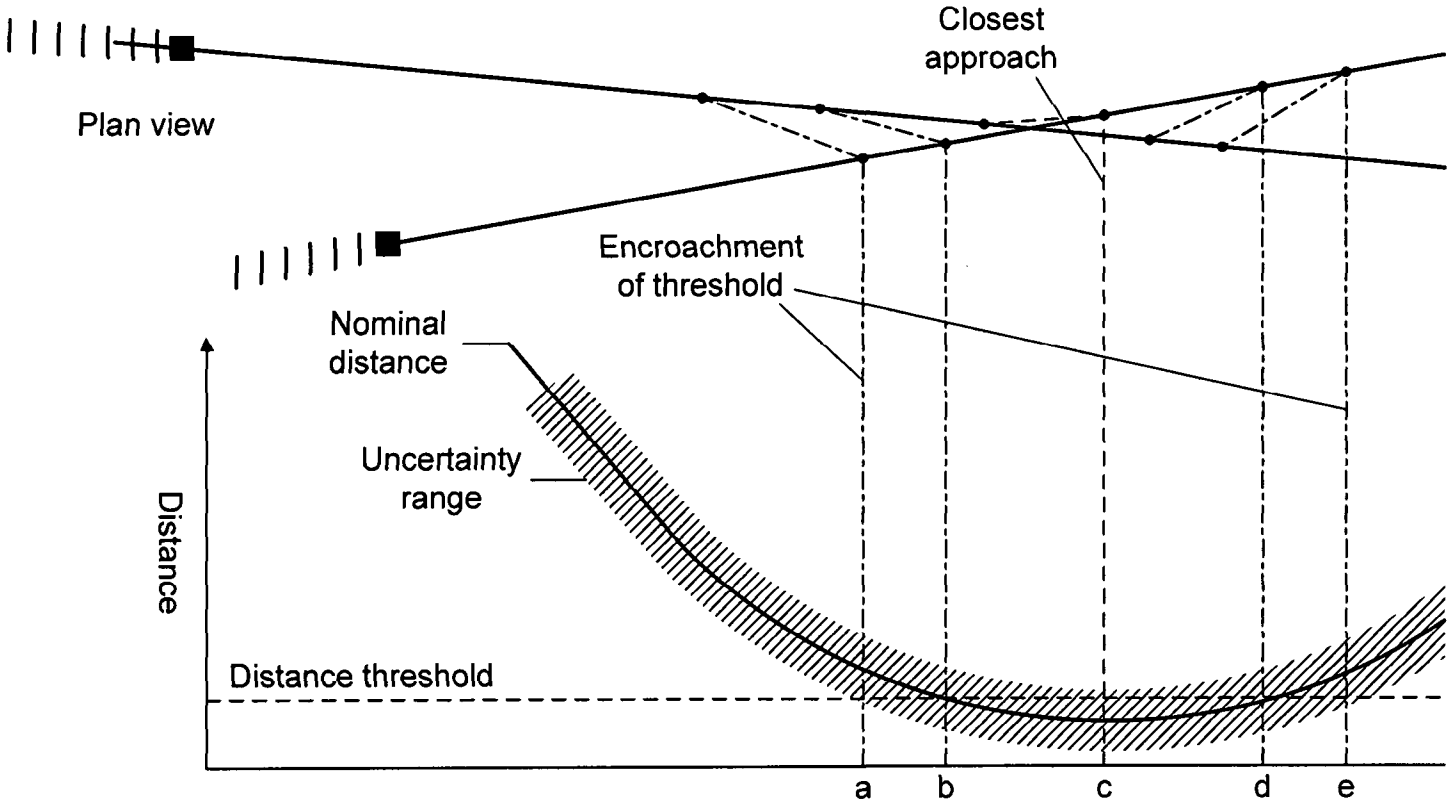
FIG. 10 is a graph of distance over time showing the variation in distance between two flights corresponding to those of FIG. 9.

FIG. 10 shows the two trajectories of the aircraft converging in a plan view. They could, however, be diverging or separated in altitude; the fact that the trajectories appear in plan view to cross does not indicate whether the interaction between the aircraft is problematic, because it does not indicate whether both aircraft arrive simultaneously at the intersection.

The medium term conflict detector 1084 receives the trajectory data for each aircraft from the trajectory predictor 1082. As discussed above, each trajectory consists of a plurality of position points, the data at each point including time position (X, Y), altitude, ground speed, ground track, vertical speed, uncertainty co-variance (i.e. an along-track and an across-track uncertainty measurement) and altitude uncertainty. The medium term conflict detector 104 can interpolate the corresponding data values at intervening points, where necessary.

Each aircraft in, approaching or exiting the planning sector S is in turn tested against all other aircraft in and approaching or exiting the sector to determine all pairs of potential interactions. In preferred embodiments, each of the actual and implied trajectories for each aircraft is tested against both the actual and implied trajectories for each other aircraft to detect interactions.

The medium term conflict detector assesses the interaction between each pair of aircraft and calculates a data set representing each such interaction, including the first point in time at which they may (taking into account uncertainty) approach each other too closely; the time of closest approach; and the time in which they separate sufficiently from each other after the interaction.

The interactions are classified by seriousness. Where the distance $d_{nom}$ between the predicted aircraft tracks at closest approach is less than the minimum acceptable separation (i.e. 5 nautical miles), the interaction is classified by the MTCD 1084 as being a "breached" interaction, in other words, one in which loss of separation is predicted.

Where this is not the case but, nonetheless, the distance $d_{cert}$ between the uncertainty ellipses around the aircraft tracks at closest approach is less that the minimum acceptable separation (i.e. 5 nautical miles), the interaction is classified by the MTCD 1084 as being a "breach potential" interaction, in other words, one in which loss of separation is a possibility given the currently calculated trajectory uncertainties.

If at the point of closest approach, either $d_{cert}$ nor $d_{nom}$, (the nominal distance between the aircraft courses) is less than the "of interest" distance threshold (i.e. 20 nautical miles), where either of the aircraft is not on a heading and the speeds of the aircraft involved will not provide the necessary longitudinal separation, the interaction is classified as "not assured". On the other hand, when both aircraft are on a heading and there is also a minimum "plan-view" (i.e. azimuthal or horizontal) separation of 5 nautical miles, or the speeds of both aircraft (whether restricted or not) provide the necessary longitudinal separation, the faster being ahead of the slower, the MTCD 1084 classifies the interaction as "assured".

The interactions are classified by geometry into "head on" (where the relative heading lies between 135-225°); "following" (where the relative headings lie between plus/minus 45°); and "crossing" (where the relative headings lies at 45-135° or 225-315°). Other angular bands are of course possible.

In preferred embodiments, in addition to defining pairs of aircraft involved in an interaction, for each aircraft, "context" aircraft are also detected and highlighted to controllers. These are aircraft which have anticipated vertical and lateral profiles (from their actual or implied trajectories) which may be of interest in planning a profile for the subject aircraft even though they do not currently interact with it. They may be controlled by tactical controllers of neighbouring tactical sectors.

Filter Program 1086

The filter program operates to filter out interactions both at super-sector and at tactical sector level, with the intention of providing each tactical controller workstation with only that subset of the interactions occurring in the super-sector which are relevant to that tactical controller.

Super-sector Level

At super-sector level, the filter program filters out pairs of flights which the medium term conflict detector 1084 need not probe for tactical interactions. These cases involve flights not yet Within the jurisdiction of the sector (i.e. not yet "Incomm"), or those which have already left its jurisdiction (i.e. are "Outcomm"). Other pairs of aircraft are removed from probing at a given sector if it is determined, from an adapted set of rules that are specific to the sector(s), that local operational procedures dictate that another air traffic control agency has the responsibility for providing separation between the flights involved. Removing the need to probe these flights not only removes the interactions from the displays of the sector controllers but also reduces the processing load demands of the medium term conflict detector 1084 on the server computer 108.

Interactions between Flights Arriving from Same Sector

The basic concept used to filter flights coming into the super-sector is responsibility—where two flights are being offered to the planning controller of the super-sector both from the same neighbouring planning sector, it is the responsibility of the controller team of the neighbouring super-sector to provide necessary separation. In the preferred embodiment, therefore, interactions between such flights will not be shown at any of the tactical controller workstations of the receiving sector whilst the neighbouring super-sector is still in control of the flights—for the reason that the controllers have neither the power nor the responsibility to sort out the interaction.

When one of the flights has been transferred to the sector, the sector planning controller and tactical controller are in radio contact with the pilot (i.e. they are "Incomm"), and input a signal via the keyboard or mouse to indicate that they accept responsibility for the flight, which is then entered in responsibility list and the other data within the server computer 108 is updated.

At this point, the interaction (if not already solved) is no longer filtered out on the workstation of the relevant tactical controller. (It will also remain visible to the previous sector controller if they use the preferred embodiment, unless and until the second aircraft is also transferred). The entry flight level (NFL) of each flight is used to test against that of each other to determine potential interactions except that, where a flight has been accepted by the sector and is within the control of a controller, or the flight has been co-ordinated vertically through the top or bottom horizontal boundary of the sector , its cleared flight level (CFL) is used.

Interactions between Flights Arriving from Different Sectors

Where the flights arrive from different sectors, all interactions are shown, as it is the responsibility of the receiving sector to provide separation. The entry flight level (NFL) of each flight is used to test against that of each other to determine potential interactions, except that where a flight has been accepted by the sector and is within the control of a tactical controller, its cleared flight level (CFL) is used.

Interactions between Flight Not Yet in Sector Jurisdiction and Flight No Longer in Sector Jurisdiction Generally, interactions involving one aircraft not yet in sector jurisdiction and one which has already left sector jurisdiction are tested using the entry flight level (NFL) of that not yet entered and the cleared flight level (CFL) of that already departed. If the entry and exit co-ordinations are both vertical (i.e. through the top or bottom horizontal boundaries of the sector), then the cleared flight levels (CFLs) of both flights are used. However, if one aircraft is arriving from a sector and the other has departed to the same sector, the interaction is filtered out—it will be the responsibility of that neighbouring sector.

Interactions between flights which have both left sector jurisdiction

These interactions are displayed unless both have left for the same sector, or unless both have left the VOR (volume of responsibility) of the sector controllers.

Tactical Sector Level

At tactical sector level the filter program 1086 determines which tactical controller(s) should see each interaction and routes the data to the corresponding workstation 304 for display there as described below. Flights are separated into "known" flights (which are predicted to enter into the tactical sector concerned) and "related" flights (which are not). Generally, subject to the specific rules below, interactions between all pairs of "known" flights are displayed at the tactical workstation, and those between "known" flights and "related" flights, but those between pairs of "related" flights are not.

Interactions are then transmitted for display at a workstation 304 if

- one or both flights is listed as within the jurisdiction of the tactical controller in the list 1096; or if
- the loss of separation or closest point of approach between the flights occurs within the tactical sector and both aircraft are predicted to penetrate that tactical sector.

Thus, the tactical controller sees both interactions within his sector (even if not under his control) and interactions involving an aircraft for which he is responsible (even if the interaction takes place outside his tactical sector but within the same super-sector), and does not see other interactions (for which he is not responsible).

Breached interactions are displayed at the point where the separation falls below 5 nm (i.e. the loss of radar separation), and are therefore allocated to the sector containing that point, but also to the sector within which the point of closest approach occurs. Assured and not-assured interactions are displayed at point of closest approach (i.e. the point along the trajectory of each aircraft where it is closest to the other) and are therefore allocated to the sector containing that point. Since each aircraft has a point of closest approach on its trajectory, this too may result in the interaction being displayed on two neighbouring tactical controller workstations 304.

Some interactions passing the above rules are further filtered out.

Figure 11:
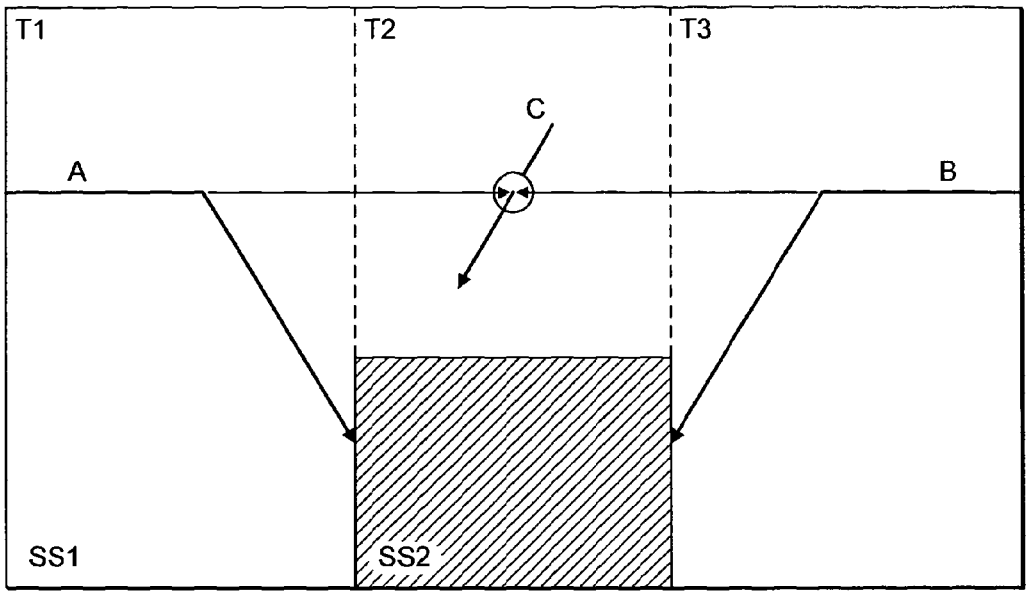
FIG. 11 is a diagram showing two interacting aircraft passing through tactical and planning sectors.

Referring to FIG. 11, although the two flights A and B have actual trajectories resulting in an interaction within tactical sector T2 lying within super-sector SS1, both are intended to depart into super-sector SS2 and never enter into tactical sector T2, and this is determined from their implied or "planning" trajectories. The interaction is therefore suppressed for the workstation of sector T2 by the filter program 1086.

Interactions between "known" flights (which are predicted to enter into the tactical sector concerned) and "related" flights (which are not) are suppressed for the workstation of the tactical controller within whose sector the interaction is predicted to occur. The rationale is that the controller of the neighbouring tactical sector within which the "related" flight is located (and who is therefore responsible for it) will see the interaction, and has the responsibility of keeping his aircraft clear. Should, however, the "related" aircraft actually pass into the sector where the interaction is predicted, it becomes "known" to the controller thereof and the interaction will become visible on his workstation 304. Preferably, also, the filtering ceases when the time to interaction falls below a predetermined threshold (indicating that the problem still exists and requires urgent resolution).

Figure 12:
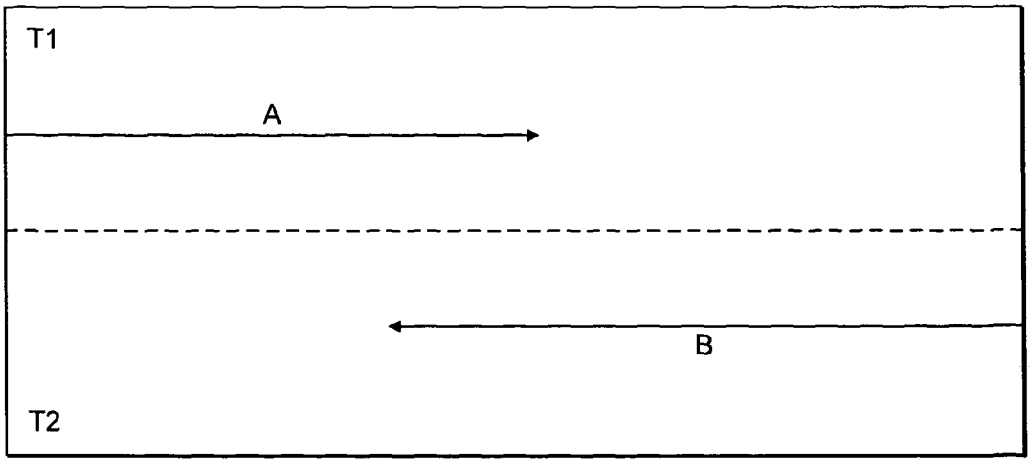
FIG. 12 is a diagram showing two interacting aircraft passing through two neighbouring tactical sectors.

Any interaction will be displayed at at least one workstation. Thus, where the interaction occurs in both tactical sectors (i.e. the closest point of approach for each aircraft lies in a different sector, as shown in FIG. 12 for aircraft A and B in tactical sectors T1 and T2 mapped to the same super-sector), it is not filtered and therefore is visible to both controllers.

Human Machine Interface

Some of the displays available on the screen 314 of the tactical controller workstations 304 will now be discussed.

Lateral Display

Figure 13:
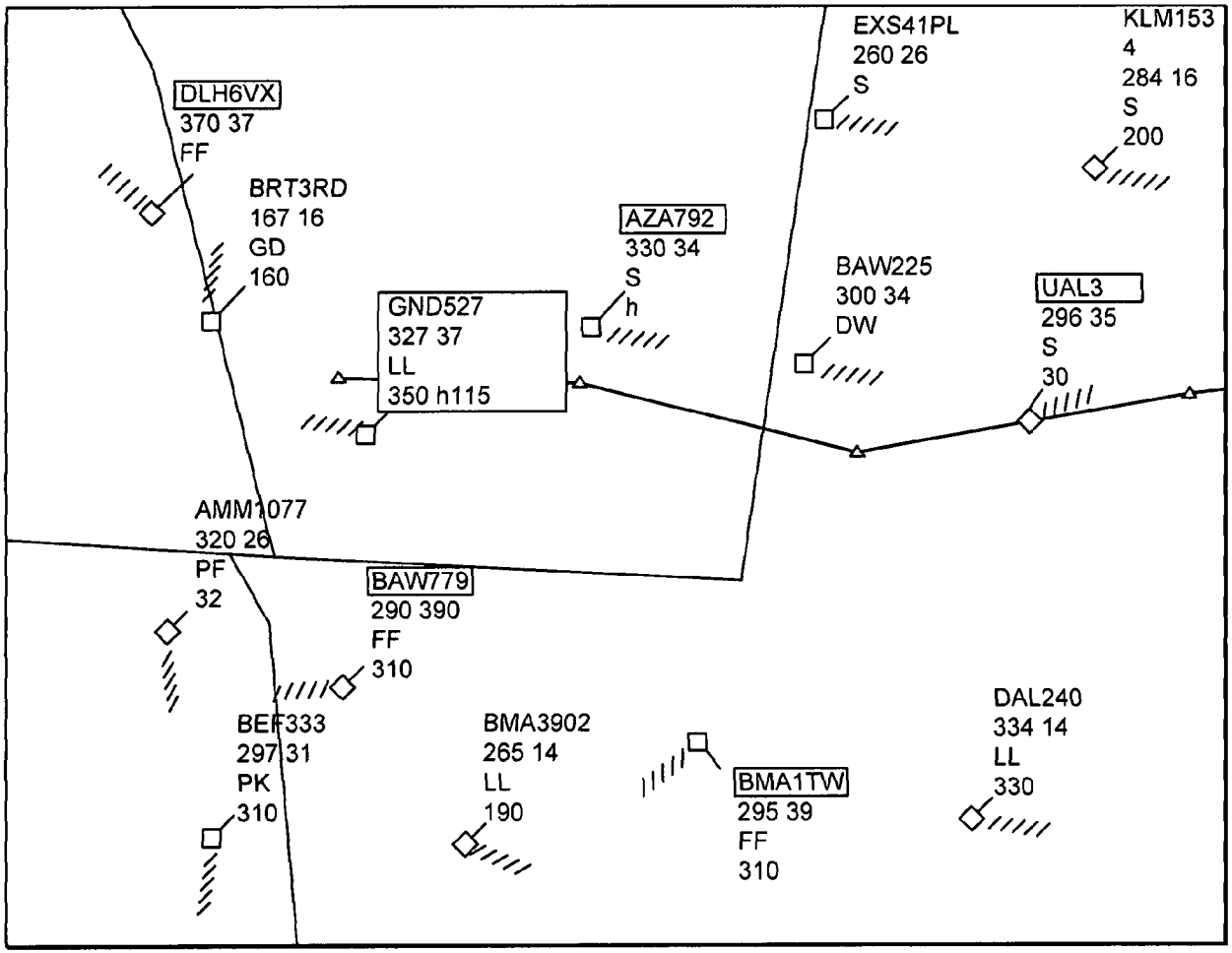
FIG. 13 shows a screen display on a tactical controller workstation indicating a plot of aircraft lateral position and track displayed in an embodiment of the workstation of FIG. 2.

FIG. 13 shows a conventional lateral display in which a simplified plan view of the aircraft tracks is given superimposed onto the radar situation display, with arrows indicating the directions of flight and predicted aircraft positions at closest approach. In this embodiment, the colour in which the callsign information is shown depends on the state of the flight, in the following manner:

- For "related" flights (i.e. those not predicted to enter the tactical sector with which the workstation is associated, but predicted to enter another tactical sector within the super-sector), the callsign is shown in a first colour (e.g. blue);
- For "known" flights (i.e. those predicted to enter the sector with which the workstation is associated) when the controller is not yet in communication with the flight, the callsign is shown in a second colour (e.g. yellow);
- For "known" flights when the flight will imminently call on frequency (because it is approaching the sector boundary), the callsign is highlighted (e.g. shown against a light background);
- For "known" flights with which the controller is in radio communication (i.e. is "Incomm"), the callsign is shown in a third colour (e.g. bright green);
- For "known" flights with which the controller is no longer in radio communication (i.e. is "Outcomm") but has not yet established communication with the next sector, the callsign is shown in a fourth colour (e.g. bright cyan), and For "known" flights with which the controller is no longer in radio communication (i.e. is "Outcomm"), and is known to have established communication with the next sector, the call sign is shown in a fifth colour (e.g. dark green).

A tactical controller can select ("hook") one of the displayed flights using the keyboard or mouse. On doing so, the display shows a coloured background around the hooked flight as shown in FIG. 13 for flight CNO627. At the same time, the HMI adds boxes around those neighbouring flights which are "context" flights for the hooked aircraft, as shown in FIG. 13 for flights DLH6VX, AZA292, UAL3, BAW779 & BMA1TW. As indicated above, these are aircraft which have anticipated vertical and lateral profiles which may be of interest in planning a clearance for the subject aircraft even though they may not currently interact with it. When planning the course of action for the hooked flight, the controller is therefore able to see instantly which other flights need to be taken into account, and whether he is or will be responsible for them.

Separation Monitor

Figure 14:
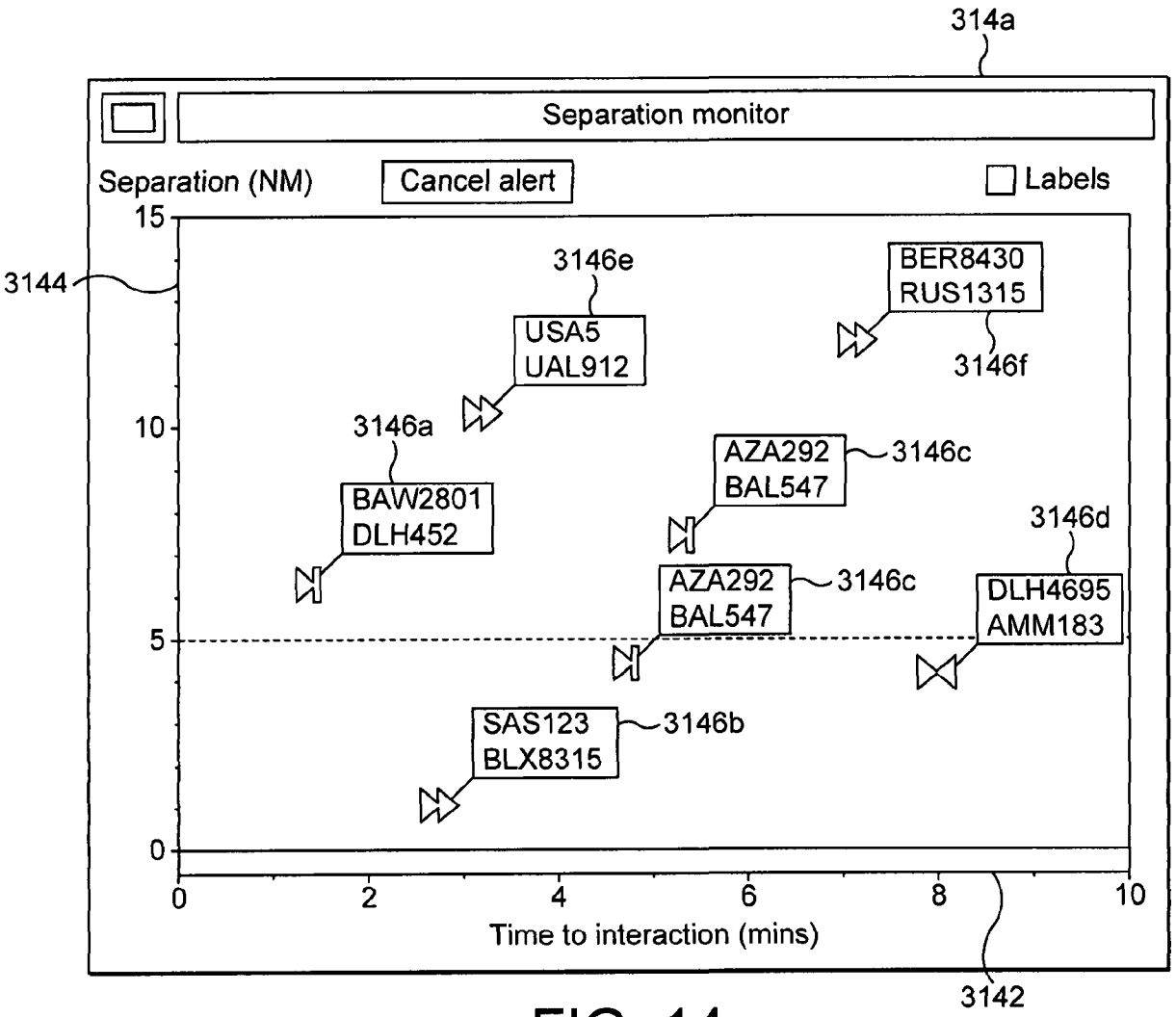
FIG. 14 shows a screen display on a tactical controller workstation indicating a plot of separation against time displayed in an embodiment of the workstation of FIG. 2.

FIG. 14 shows a Separation Monitor display comprising a horizontal axis 3142, displaying time (in minutes) to an interaction, and a vertical axis 3144 for indicating predicted separation (in nautical miles) between paired aircraft. In this embodiment, the time to interaction indicated is the time to the point of loss of separation (i.e. the beginning of the interaction) for breached interactions, or the time of nominal closest approach for assured or not-assured interactions.

A plurality of symbols are shown (labelled 3146*a*-3146*g*) each representing a respective interaction between pair of aircraft. Each symbol consists of a colour and a shape, at a position on the graph representing a separation at a future time. It has an associated label comprising a box including the identification codes (callsigns) of the two flights. The shape indicates the classification of the type of interaction geometry (catching up, crossing or head-on), as follows:

two arrows pointing in the same direction indicates a catching up interaction where one aircraft is overhauling another, (i.e. they are flying on roughly parallel or converging headings);

an arrow meeting a bar indicates that the interaction is a crossing-type interaction (in other words, one aircraft is approaching from the side of the other);

two arrowheads meeting each other indicates that the interaction is a reciprocal (or head-on)-type interaction.

The colour indicates the seriousness of the predicted interaction:

red indicates a breached interaction (as defined above);

orange indicates a breach potential interaction (as defined above)

yellow indicates a "not assured" interactions (in other words, the aircraft in each case are either following their own navigation or speeds, or have been instructed to follow headings that do not provide 5 miles horizontal separation); and green corresponds to an "assured" classification.

The generation and use made of these indications is described in greater detail in our earlier applications WO2007/072028 and WO2007/072015 (incorporated herein by reference). The interactions which are shown at each tactical workstation 304 are those filtered by the filter program 2086 as discussed above.

Level Assessment Display

Figure 15:
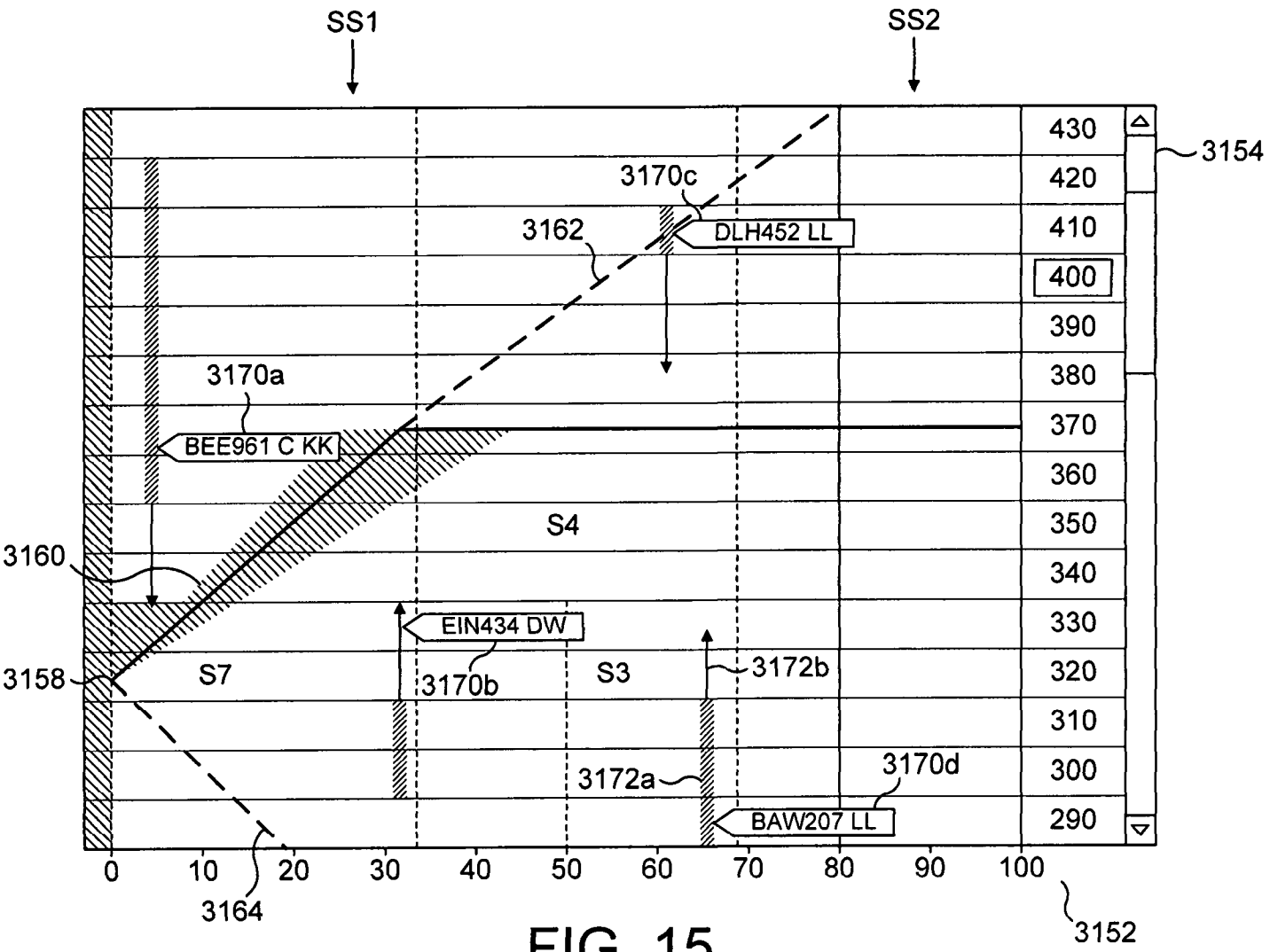
FIG. 15 is a user interface showing a display on a tactical controller workstation of altitude against along track distance for a selected aircraft and indicating potential interactions with other aircraft, and including a tactical instruction (clearance) entry portion.

Referring to FIG. 15, a third display is shown allowing the controller to plan for vertical risks. The third display provides a horizontal axis 3152 showing distance (although time could alternatively be used) and a vertical axis 3154 showing altitude.

A point 3158 located at zero along the distance axis shows the present altitude of the currently selected flight, and the line 3160 indicates the predicted profile of the flight concerned. This is normally the currently predicted profile of the aircraft, but in the preferred embodiment the controller can additionally enter a tentative, or "what-if" trajectory, to test the effect before issuing instructions to the pilot.

In this case, it will be seen that the profile 3160 indicates a climb to a flight level of 370 (i.e. a pressure altitude of 370*100=approximately 37,000 feet, depending on local atmospheric pressure in relation to standard pressure of 1013 mbars) at a distance of 30 nautical miles ahead of the subject aircraft along its trajectory, followed by level flight at that flight level. An extension line 3162 extends the climb portion of the track 3160, so as to indicate the effect of the aircraft continuing to climb rather than entering level flight. and a track 3164 indicates the nominal descent rate of which the aircraft is capable.

Also shown are four symbols 3170*a*, 3170*b*, 3170*c*, 3170*d* indicating interactions with other aircraft. As before, each symbol has a shape and a colour, and the shapes and colours have the same meaning as discussed above.

The display shows the planning(or super-sector) and tactical sector boundaries. The aircraft is in tactical sector S7. The planning sector boundary is at 80 nm laterally. The boundary with tactical sector S4 runs horizontally at flight level 345. The boundary with tactical sector S3 runs vertically from 50 nm up to flight level 345.

The cleared range of altitudes is shown by a coloured box (e.g. 3172*a*) running between the current altitude and the cleared flight level (if different) stored for the flight; the box is hollow at levels for which there is no predicted interaction with the flight and solid at those levels for which an interaction is predicted. Also shown for each flight are vertical lines indicating "vertical intent". These are an arrowed line (e.g. 3172*b*) showing further altitude changes derived from the implied trajectory calculated, as discussed above, (from CFL to XFL).

Some aspects of the generation and use made of these indications are described in greater detail in our earlier applications WO2007/072028 and WO2007/072015 (incorporated herein by reference).

Inter-controller Cooperation Messaging

In order to allow tactical controllers to cooperate on aircraft and interactions which span two or more tactical sectors, in preferred embodiments a dedicated messaging system allows workstations 304 to send collaboration messages. These messages comprise two request types:

Resolution request. A message sent by a first controller with separation responsibility for a first flight to ask a second controller controlling a second flight to ensure that the second flight avoids the first in an agreed manner.

Interaction request. A message sent by a first controller controlling a first flight to ask a second controller controlling a second flight whether he will accept responsibility to resolve the interaction.

Figure 16:
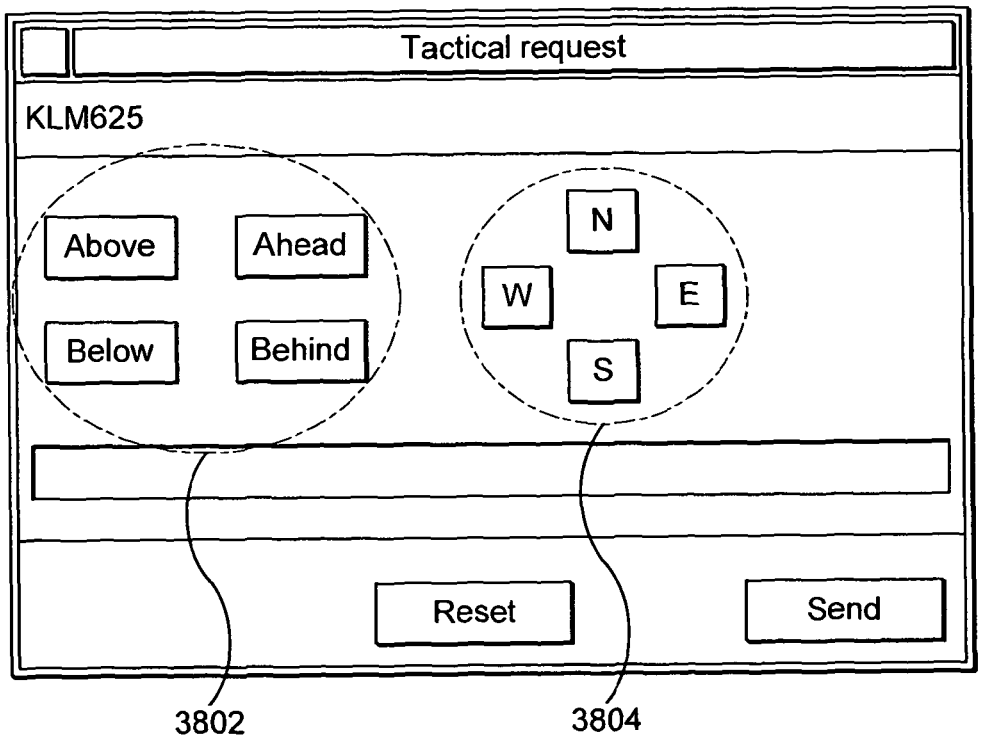
FIG. 16 is a user interface showing a message input screen on a tactical controller workstation.

Referring to FIG. 16, a resolution request message input screen is generated by the first controller "hooking" (i.e. selecting) a first flight (that is controlled by a second controller) using the mouse of his workstation 304*a*. It comprises an indication of the identity of the flight concerned, and buttons indicating the direction the second controller is requested to route the flight, comprising a first set of buttons 3802 labelled "above", "below", "ahead", "behind", and a second set of buttons 3804 labelled "North", "South", "East" and "West". Optionally, the first controller can identify a second flight against which this resolution is being requested.

By clicking on the "send" button", the first controller causes his workstation 304*a* to generate a message comprising fields indicating:

The first aircraft (here: KLM625);

The requested resolution, and if included;

The second aircraft (i.e. the one right-clicked on).

The workstation 304*a* passes the message to the server computer 108 which determines the workstation 304*b* of the controller responsible for the first aircraft and routes the message there, where it is displayed in a text window. The second controller can then signal acceptance or rejection of the request back to the first.

Similarly, an interaction request is generated by a first controller left-clicking on an interaction menu invoked from an interaction shown in the Separation Monitor display. Provided that the first controller is responsible for a first of the-flights involved and a second controller for the. second of the flights, a request will be sent to the second specifying the pair of aircraft concerned and the nature of the interaction (e.g. head-on, following and so on), and the second can signal back acceptance or rejection, as with a resolution request message. The second controller can then take over responsibility for the interaction, or plan the necessary trajectory changes and signal them back to the first.

Each of the two workstations maintains a list of requests made and requests received, together with their status (eg accepted or refused) which is displayed by the HMI.

It will be clear that the messaging described in this embodiment could be used separately of the filtering and other features of the above-described embodiments, and that they could be used without messaging (as telephonic communication between controllers is available).

Summary of Working Methods Using the Above Embodiments

The use of the above embodiments will by now be clear but a few additional summary comments may be useful. A tactical controller is primarily responsible for flights in his own tactical sector, but the present preferred embodiments allow him to look ahead, using the vertical tool to assess flights with overlapping altitudes, and plan a route all the way to the planning sector (i.e. super-sector) boundary, using caution. If he sees a clear route, the tactical controller can allocate an exit flight level and the aircraft can, if necessary, remain under his control until it exits the super-sector, even though it passes through other tactical sectors.

Accordingly, in the present invention, responsibility does not always pass when an aircraft crosses a tactical sector boundary, but instead the system maintains responsibility with the tactical controller with whom radio communications are currently kept, and passes responsibility coincidently with the transfer of radio communications from one controller to another.

Thus, tactical controllers do not normally need to negotiate exit and entry levels between sectors, as planning controllers do in the prior art. Negotiation (or coordination) is required only should there be a problem to resolve, and not by a standing procedure. This interworking method may be termed "collaboration".

The tactical controllers see any flights in neighbouring tactical sectors within the same super-sector which either approach closely enough to be of interest or overlap in intended future altitude with the flights they currently control, and can therefore take these into account when making plans across the whole planning sector.

If an interaction cannot readily be resolved by the tactical controller controlling one aircraft, he can request his neighbouring tactical controller controlling the other aircraft to either control that aircraft away from the first, or to resolve the entire interaction.

Thus, the number of planning controllers can be reduced without reducing safety levels by providing tools allowing tactical controllers to manage aircraft across multiple contiguous tactical sectors within and mapped to a larger super-sector, at the same time giving them access to information on some but not all aircraft outside their tactical sectors but within the larger super-sector.

Other Variants and Embodiments

Although embodiments of the invention have been described above, it will be clear that many other modifications and variations could be employed without departing from the invention.

Whilst one host computer has been described as providing the trajectory prediction and conflict detection functions for a sector of airspace, the same functions could be distributed over multiple computers or, alternatively, all calculations for multiple sectors could be performed at a single computer. However, it is found particularly convenient to provide one (or more) servers for each sector, since it is then only necessary to calculate the limited number of interactions between aircraft in that sector (it being appreciated that the number of interactions rises as the square of the number of aircraft).

Whilst the terminals are described as performing the human machine interface and receiving and transmitting data to the host computer, "dumb" terminals could be provided (or calculation being performed at the host). Many other modifications will be apparent to the skilled person.

The invention claimed is:

1. An air traffic control system, for use by a plurality of controllers controlling a plurality of aircraft, comprising a plurality of workstations each comprising a processor, an input device and a display device, said plurality of workstations comprising at least one planning controller workstation for use by a planning controller, and a plurality of tactical controller workstations each for use by a respective tactical controller; and a control computer in data communication with each workstation of the plurality of workstations, said control computer stores sector mapping data mapping a plurality of tactical sectors to a combined sector, and is arranged to allocate one planning controller workstation to each combined sector and one tactical controller workstation to each tactical sector, said control computer is arranged to filter and transmit to each said tactical controller workstation interaction data for display, wherein each tactical controller workstation is operable to display:

first aircraft interactions between a first plurality of aircraft predicted to occur within the tactical sector allocated to that tactical controller workstation, and second aircraft interactions between a second plurality of aircraft predicted to occur in other tactical sectors within the combined sector to which that tactical sector is mapped if each said second aircraft interaction involves at least one aircraft currently under responsibility of the respective tactical controller of the tactical controller workstation, and said first aircraft interactions comprising predicted future close approaches between members of the first plurality of aircraft and said second aircraft interactions comprising predicted future close approaches between members of the second plurality of aircraft.

2. A system according to claim 1, arranged to allow each said tactical controller to retain control of an aircraft after it leaves their respective tactical sector and enters that of another said tactical controller within the combined sector to which both tactical sectors are mapped.

3. A system according to claim 2, in which each said tactical controller is permitted to input, for an aircraft currently under their control, a cleared flight level achieving an exit from the combined sector to which the tactical controller's tactical sector is mapped, said cleared flight level lying in another tactical sector mapped to the same combined sector.

4. A system according to claim 2, further comprising a messaging platform allowing each tactical controller to send messages to others allocated to tactical sectors mapped to the same combined sector.

5. A system according to claim 4, in which said messages comprise a message requesting that another tactical controller manage an interaction between a defined pair of aircraft.

6. A system according to claim 1, in which each said tactical controller is permitted to input, for an aircraft currently under their control, a cleared flight level achieving an exit from the combined sector to which the tactical controller's tactical sector is mapped, said cleared flight level lying in another tactical sector mapped to the same combined sector.

7. A system according to claim 6, further comprising a messaging platform allowing each tactical controller to send messages to others allocated to tactical sectors mapped to the same combined sector.

8. A system according to claim 7, in which said messages comprise a message requesting that another tactical controller manage an interaction between a defined pair of aircraft.

9. A system according to claim 7, in which said messages comprise a message requesting that another tactical controller instruct a specified aircraft to take a specific action.

10. A system according to claim 1, wherein said predetermined interaction criteria exclude interactions between aircraft, both of which are:

(a) outside the jurisdiction of the combined sector, and (b) entering or exiting the combined sector from or to the same neighbouring sector.

11. A system according to claim 1, wherein said predetermined interaction criteria exclude interactions for a tactical sector occurring outside that tactical sector between aircraft neither of which (a) is predicted to enter that tactical sector and (b) is under control of the controller of that tactical sector.

12. A system according to claim 11, wherein said predetermined interaction criteria exclude, for a first tactical sector, interactions between aircraft which, on their current trajectories, would interact within said first tactical sector but where the flight plan for said aircraft indicates that neither will enter said first tactical sector.

13. A system according to claim 11, wherein said predetermined interaction criteria exclude, for a first tactical sector, an interaction between a pair of aircraft which would interact within said first tactical sector, where one of said aircraft is in, or predicted to enter, said first sector and the other is not.

14. A system according to claim 1, in which said tactical controller workstation is arranged to selectively show a horizontal separation display showing said first and second aircraft interactions.

15. A system according to claim 1, in which said tactical controller workstation is arranged to selectively show a vertical separation display showing, in relation to a reference aircraft selected by the tactical controller, indications of any second aircraft whose current flight level, predicted flight level or future flight plans overlap with those of said reference aircraft, and in which said control computer is arranged to determine said overlaps and to transmit display data for said vertical separation display to said tactical controller workstation.

16. A system according to claim 1, in which said tactical controller workstation is arranged, for a reference first said aircraft selected by the tactical controller, to selectively show any of a set of second said aircraft which are a subset of the flights for which data is stored in relation to the combined sector to which that tactical sector is mapped, and whose current cleared horizontal path and flight level, or future predicted vertical profile, through the combined sector to a planned exit flight level are predicted, from their respective trajectories, to have the potential to come into a predetermined proximity to that reference first said aircraft.

17. A system according to claim 1, in which said control computer is arranged to store data defining, for each aircraft within a planning sector;

(a) the flight plan;

(b) any cleared flight level input by a said tactical controller;

(c) the exit flight level of the planning sector;

and is arranged to detect when the current aircraft position deviates from said flight plan and to calculate an implied trajectory of said aircraft between said current aircraft position and said exit flight level, taking into account any said cleared flight level.

18. A system according to claim 1, further comprising a messaging platform allowing each tactical controller to send messages to others allocated to tactical sectors mapped to the same combined sector.

19. A system according to claim 18, in which said messages comprise a message requesting that another tactical controller manage an interaction between a defined pair of aircraft.

20. A system according to claim 18, in which said messages comprise a message requesting that another tactical controller instruct a specified aircraft to take a specific action.

21. An air traffic control system, for use by a plurality of controllers controlling a plurality of aircraft, comprising:

a plurality of workstations each comprising a processor, an input device and a display device, said plurality of workstations comprising at least one planning controller workstation for use by a planning controller, and a plurality of tactical controller workstations each for use by a respective tactical controller; and a control computer in data communication with each workstation of the plurality of workstations, said control computer stores sector mapping data mapping a plurality of tactical sectors to a combined sector, and is arranged to allocate one planning controller workstation to each combined sector and one tactical controller workstation to each tactical sector, said control computer is arranged to filter and transmit to each said tactical controller workstation interaction data for display, wherein each tactical controller workstation is operable to display:

first aircraft interactions between a first plurality of aircraft predicted to occur within the tactical sector allocated to that tactical controller workstation, and second aircraft interactions between a second plurality of aircraft predicted to occur in other tactical sectors within the combined sector to which that tactical sector is mapped if each said second aircraft interaction involves at least one aircraft currently under responsibility of the respective tactical controller of the tactical controller workstation, said first aircraft interactions comprising predicted future close approaches between members of the first plurality of aircraft and said second aircraft interactions comprising predicted future close approaches between members of the second plurality of aircraft, and said system is arranged to allow each said tactical controller to retain control of an aircraft after it leaves their respective tactical sector and enters that of another said tactical controller within the combined sector to which both tactical sectors are mapped.

* * * * *